United States Patent [19]

Irresberger et al.

[11] 4,264,237

[45] Apr. 28, 1981

[54] METHOD FOR CONTROLLING A HYDRAULICALLY OPERATED MINE ROOF SUPPORT AND AN ARRANGEMENT FOR CARRYING OUT THE METHOD

[75] Inventors: Herrmann Irresberger, Essen; Friedrich Graäwe, Dorsten, both of Fed. Rep. of Germany

[73] Assignee: Bergwerksverband GmbH, Essen, Fed. Rep. of Germany

[21] Appl. No.: 56,253

[22] Filed: Jul. 10, 1979

[30] Foreign Application Priority Data

Jul. 12, 1978 [DE] Fed. Rep. of Germany ..... 2830510

[51] Int. Cl.[3] ..... E21D 15/44; E21D 23/16

[52] U.S. Cl. ..... 405/302

[58] Field of Search ..... 405/290–302; 299/31; 91/170 MP

[56] References Cited

U.S. PATENT DOCUMENTS

| | | | |
|---|---|---|---|
| 3,246,576 | 4/1966 | Kibble et al. | 405/302 X |
| 3,421,795 | 1/1969 | Heyer et al. | 405/302 X |

FOREIGN PATENT DOCUMENTS

| | | | |
|---|---|---|---|
| 1191777 | 4/1965 | Fed. Rep. of Germany | 405/302 |
| 1279582 | 10/1968 | Fed. Rep. of Germany | 405/302 |
| 2640185 | 3/1978 | Fed. Rep. of Germany | 405/302 |
| 1179758 | 1/1970 | United Kingdom | 405/302 |

*Primary Examiner*—Dennis L. Taylor
*Attorney, Agent, or Firm*—Michael J. Striker

[57] ABSTRACT

A method of operating a hydraulically expandable and collapsable prop of a mine roof support in which the cylinder space of the prop below the piston therein normally communicates with an overpressure valve adjusted to a pressure equal to the setting pressure of the prop, wherein the method comprises the steps of interrupting communication of the overpressure valve with the cylinder space of the prop while the latter is expanded and restoring the communication when the prop is pressed against the mine roof while the cylinder space is disconnected from the hydraulic pressure circuit and an arrangement for carrying out the method.

13 Claims, 9 Drawing Figures

1
1a
3
3.11
2.2
3.2
2.11
2.12
2.13
3.7
3.1
3.5
3.3
3.8
3.9
2.1
3.4
2
3.6
2.4
2.5
3.13
3.10
3.14
3.12
3.15
3.16
3.18
3.17
3.19
3.20

R
1
2
2.1
2.1.1
2.1.2
2.2
3.1
3.5
3.6
3.10
3.11
3.12
3.13
4
4.1
4.2
5
5.0
5.1
6
7
319
320

METHOD FOR CONTROLLING A HYDRAULICALLY OPERATED MINE ROOF SUPPORT AND AN ARRANGEMENT FOR CARRYING OUT THE METHOD

BACKGROUND OF THE INVENTION

The present invention relates to a method of controlling the setting pressure of a mine roof support, whereby the setting pressure is equal to the adjusting pressure of an overpressure valve communicating with the interior of the prop of the mine roof support for protecting the latter against excessive stresses, as well as to an arrangement for carrying out the method.

In modern operations of advancing an underground mining gallery, the roof of the mining gallery is supported by a hydraulically operated advanceable mine roof support. Such a mine roof support is advanced at short steps toward the front of the mine gallery as the latter is driven forwardly. During such advance the hydraulically operated props of the mine roof support are partly collapsed and, after the finished advancing step, again expanded so that the props will engage the roof of the mine gallery. The engagement of the props with the roof of the mine gallery is usually designated as setting of the mine roof support.

During the mining of the mineral, for instance coal, the roof of the mine gallery sags. The mine roof support is not supposed and cannot prevent such sagging of the mine roof, but it should take up such movement to act with a constant high force onto the mine roof, so that the sagging movement of the latter does not proceed in an uncontrolled manner to thereby endanger the operators working in the mine gallery. The hydraulic of the mine roof support must therefore be constructed in such a manner to permit a shortening of the props during the unavoidable movement of the mine roof and to act against such shortening of the prop with a constant high force. The hydraulic props have therefore to discharge during partial collapse of the same the thereby displaced pressure fluid. The discharge of such pressure fluid is carried out over overpressure valves, which will assure that the hydraulic pressure in the props is maintained constant to thus provide a continuous pressure against the mine roof. In general one has to distinguish between the force at which the props are set, that is the setting force with which the props support the mine roof during action of the overpressure valve and the adjusting force. In mining operations one speaks therefore of the setting pressure and the adjusting pressure. The adjusting pressure of the overpressure valves is subjected to variations due to tolerances, whereby these variations of the adjusting pressure unavoidably increase during longer use of the overpressure valves.

Usually the hydraulic circuits of hydraulic controls of mine roof support are constructed in such a manner that the adjusting pressure of the overpressure valves in the hydraulic circuit is 10 to 50% greater than the aforementioned setting pressure. This will assure that the overpressure valve during setting of the prop is not flown through by the amount of fluid provided by the pump connected to the hydraulic circuit. If the overpressure valves would be continuously flown through by the fluid stream supplied by the pump, the overpressure valves would be damaged in a very short time.

For reason of better control of the mine roof it is, however, desired to eliminate the pressure difference between setting pressure and adjusting pressure. Such pressure differences between setting pressure and adjusting pressure result in a non-uniform support of the mine roof and cause additional cracks, steps and breaks in the mine roof.

SUMMARY OF THE INVENTION

It is therefore an object of the present invention to provide a method for controlling the setting pressure of hydraulically operated props for a mine roof support, wherein the setting pressure is equal to the adjusting pressure of an overpressure valve communicating with the interior of the prop, as well as to an arrangement for carrying out the method by means of which a better control of the mine roof is obtained while a destruction of the overpressure valve is avoided.

With these and other objects in view, which will become apparent as the description proceeds, the method of the present invention of operating a mine roof support having a hydraulically operated expandable and collapsable prop to be expanded with a predetermined setting pressure against the mine roof and an overpressure valve normally communicating with the interior of the prop, that is the cylinder space below the piston therein, and adjusted to a pressure equal to the setting pressure to protect the prop against excessive stresses, mainly comprises the steps of connecting the prop to a hydraulic pressure circuit to expand and press the prop with the predetermined setting pressure against the mine roof while interrupting communication between the interior of the prop and the overpressure valve, and disconnecting the prop from the hydraulic pressure circuit after the prop has been fully expanded and restoring communication of the overpressure valve with the interior of the prop.

The arrangement for carrying out the above method includes a source of hydraulic fluid of predetermined pressure, a hydraulic circuit connecting the source to the interior of the prop, a main valve in the hydraulic circuit movable between a closed position interrupting flow of pressure fluid to the interior of the prop and an operating position in which the pressure fluid is fed into the interior and two port-two position valve means constructed and arranged in said circuit for interrupting communication of the overpressure valve with the interior of the prop when the main valve during expansion of the prop is in said operating position and for reestablishing communication between the interior of the prop and the overpressure valve after expansion of the prop and pressing the same against the mine roof while said main valve is moved to said closed position.

The two port-two position valve means may be operated by the fluid pressure in the hydraulic circuit and in this case it includes piston means movable between an open position providing communication between the interior of the prop and the overpressure valve and a closed position interrupting such communication, spring means biasing the piston means to the open position, and the hydraulic circuit including a passage feeding pressure fluid to one side of the piston means for moving the latter against the force of the spring means to the closed position, the main valve in the operating position connecting the passage to the aforementioned source and in the closed position connecting the passage to a tank so that the spring means moves the piston means to the open position. The arrangement preferably includes also a throttle in the aforementioned passage to delay movement of the piston means to the open position.

Preferably the arrangement includes a housing forming with the two port-two position valve means and the overpressure valve an integrated unit.

The main advantage of the method and arrangement according to the present invention is that by separating the overpressure valve from the hydraulic circuit of the mine roof support during the setting of the prop a dangerous flow-through of the overpressure valve by large fluid streams is avoided to thereby permit to make the setting pressure equal to the adjusting pressure of the overpressure valve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 1A, 1B, 1C:
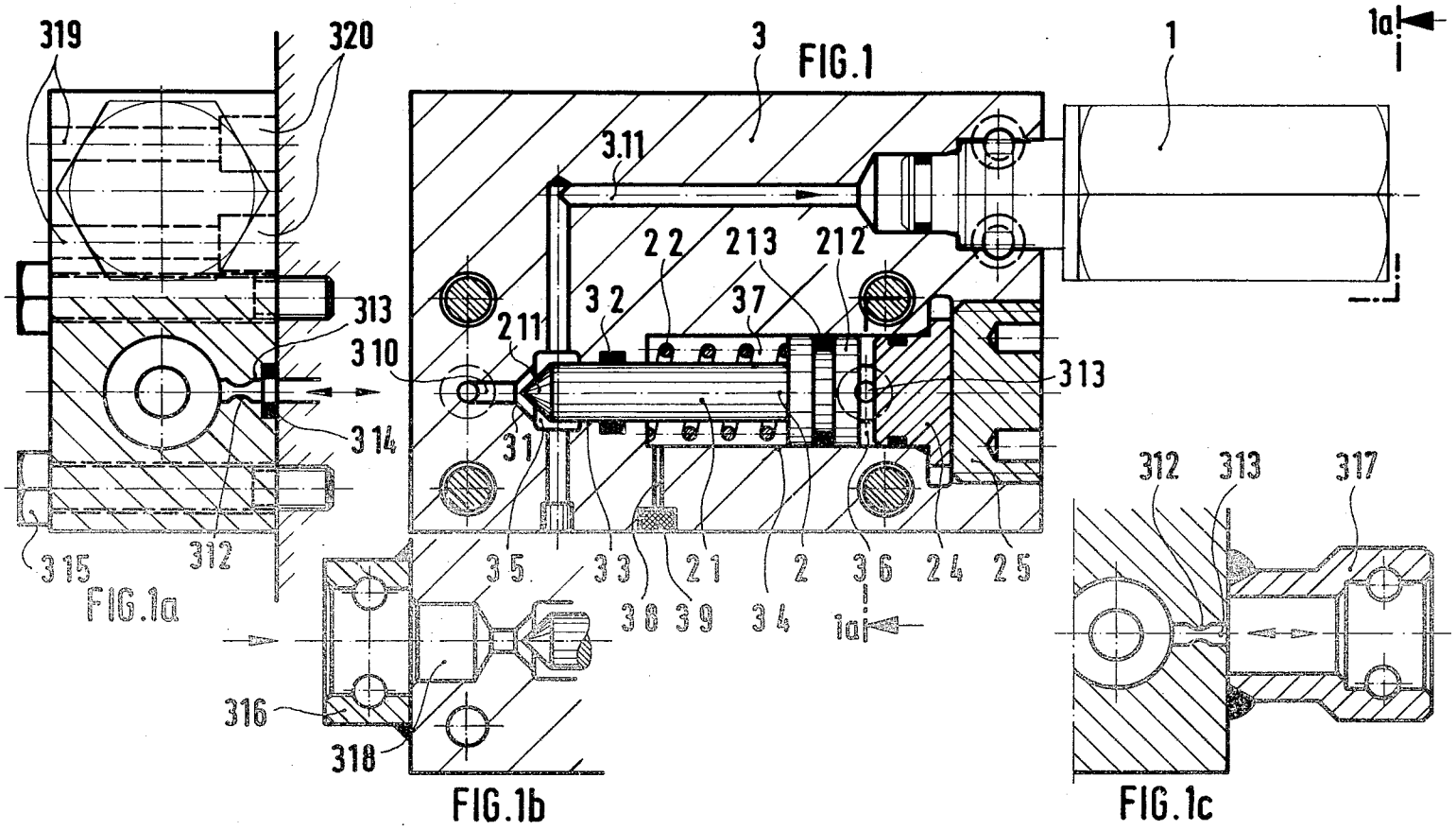
FIG. 1 is a sectioned side view of an overpressure valve and a pressure controlled two port-two position valve arranged in a housing.
FIG. 1*a* is a section taken of FIG. 1 along lines 1*a*—1*a;*
FIG. 1*b* partly illustrates a modified portion of the arrangement shown in FIG. 1.
FIG. 1*c* illustrates a modified section similar to FIG. 1*a;*

Referring now to the drawing, and more specifically to FIGS. 1 and 1*a*, it will be seen that the arrangement according to the present invention includes a housing 3 to which an overpressure valve 1 of known construction for protection of a prop of a mine roof support is connected and in which a pressure controlled two port-two position valve 2 is arranged. In the illustrated embodiment the overpressure valve 1 is releasably connected by a nipple insertable in a corresponding bore of the housing. As shown in FIG. 1*a* there are provided two bores 319 in the housing 3 for insertion of a connecting clamp and the bores 319 are each provided at the bottom face of the housing with a counter bore 320 in order to permit a spreading of the connecting clamp which when the arrangement is made as a plate construction cannot be extended beyond the bores.

As further shown in FIG. 1, the two port-two position valve 2 comprises a valve member including a shaft 21 provided at one end with a valve cone 211 and at the opposite end with a control piston 212 having an annular seal 213. The control piston 212 is guided in a large diameter bore 34 provided in the housing and pressed by a compression spring 22 against a closure member 24, closing the right end of the bore 34, and held in place by a threaded member 25 screwed into the housing 3 and engaging the right end face of the closure member 24. The shaft 21 is guided in a smaller diameter bore 33 formed in the housing and an annular seal 32 around the bore 33 seals the shaft 21. The housing 3 is further formed with a valve seat 31 arranged for engagement with the valve cone 211. The shaft seal 32, as well as the piston seal 213, prevent passage of pressure fluid from the chamber 35 adjacent the valve seat 31 or the control chamber 36 into the chamber 37 in which the spring 22 is arranged. The chamber 37 is in communication with the outer atmosphere through an additional bore 38 and a powder metal bronz filter element 39 arranged therein.

Any leakage past the seals 32 or 213 will be recognizable by passage of liquid through the filter element 39. The pretensioned pressure spring 22 presses the valve piston 212 to the open position of the valve when the control chamber 36 is substantially pressureless. In this position the valve cone 211 is disengaged from the valve seat 31, whereby the chamber 35 provides the connection between the inlet channel 310 and the channel 311 leading to the overpressure valve 1. This position is the main working position as well as the starting position.

Besides the already mentioned plate assembly, such a valve unit can also be constructed for assembly with tube or hose connections. In a plate assembly the inlet channel 310 and the control channel 313 provided with a throttle 312 end at the lower surface of the housing 3 and are sealed with proper sealing elements 314 toward a plate or the housing of a hydraulically controlled check valve to which the housing 3 is connected. The connection of the housing 3 to the respective member is carried out by screws 315, as shown in FIG. 1*a*. For the assembly of the housing 3 into a tube or hose system, the housing 3 is provided with appropriate sockets for the insertion of nipples, as for instance shown in FIGS. 1*b* and 1*c*, in which in FIG. 1*b* a holding socket 316 for the clamp of a nipple to be inserted therein is provided for the inlet channel 310, whereas FIG. 1*c* illustrates a socket 317 communicating with the control channel 313 for the insertion of a corresponding nipple. In such constructions it is advantageous to weld the holding socket 316 directly to the side face of the housing 3 and to connect the inlet channel 310 with the interior of the holding socket 316 by a bore 318.

Figure 3:
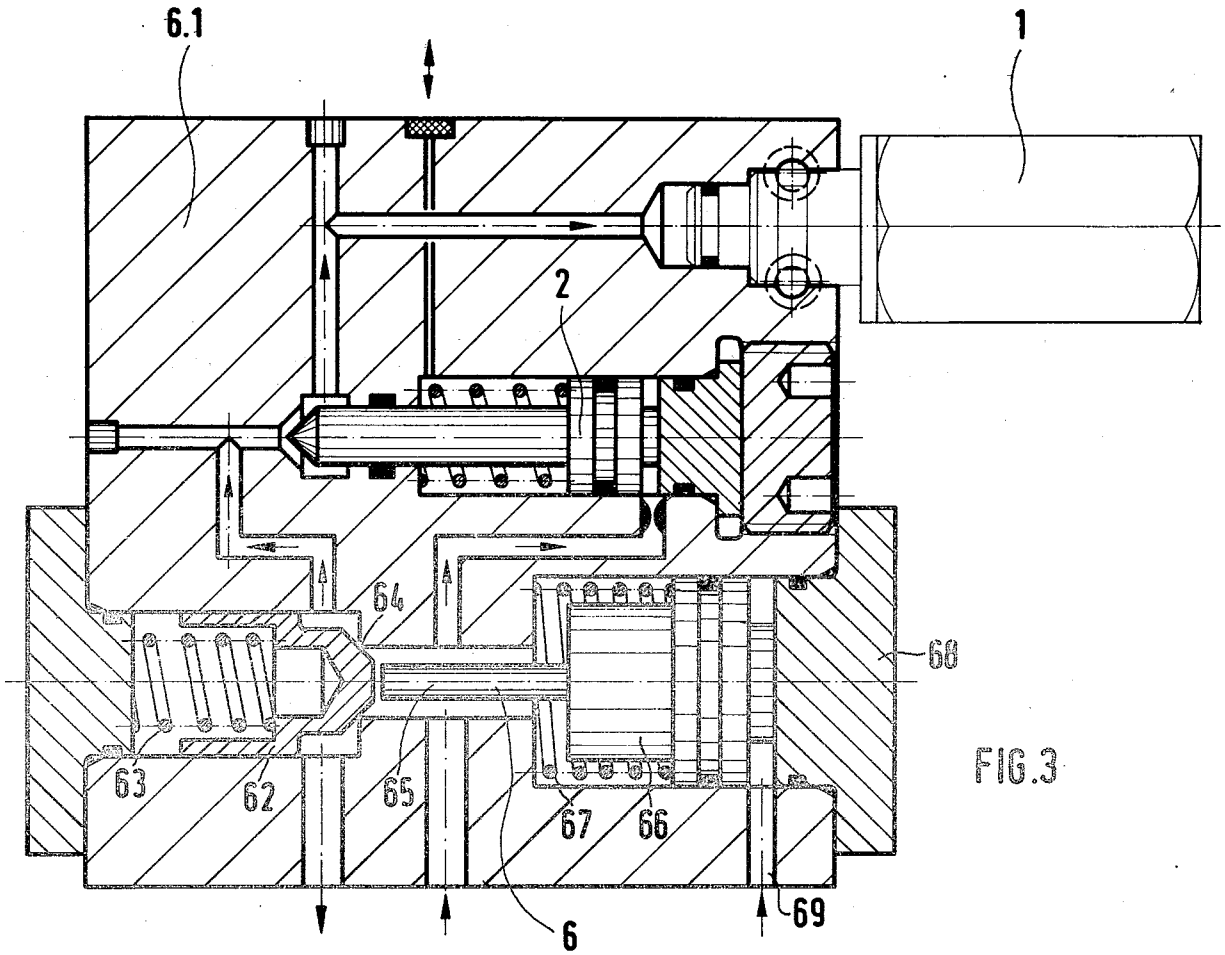
FIG. 3 illustrates a section through an arrangement according to the present invention in which the overpressure valve and the two port-two position valve, as well as a hydraulically controlled check valve are connected to a unit by a common housing.

A further embodiment according to the present invention is illustrated in section in FIG. 3, in which the overpressure valve 1 is connected to the housing 61 and the two port-two position valve 2 is arranged in the housing as described in connection with FIG. 1 and in which in addition to the aforementioned two valves also a hydraulically controlled check valve 6 is incorporated in the housing. This hydraulically controlled check valve 6 comprises a valve member 62 pressed by a spring 63 against a valve seat 64 and openable against the pressure of the spring 63 by engagement with the stem 65 on a control piston 66, normally pressed by a spring 67 against a stop member 68 sealingly connected to the housing 61, when pressure fluid is inserted through the channel 69 to press the piston 66 and the stem 65 thereon against the pressure of the spring 67 into engagement with the valve member 62.

Figures 2, 2A, 2B:
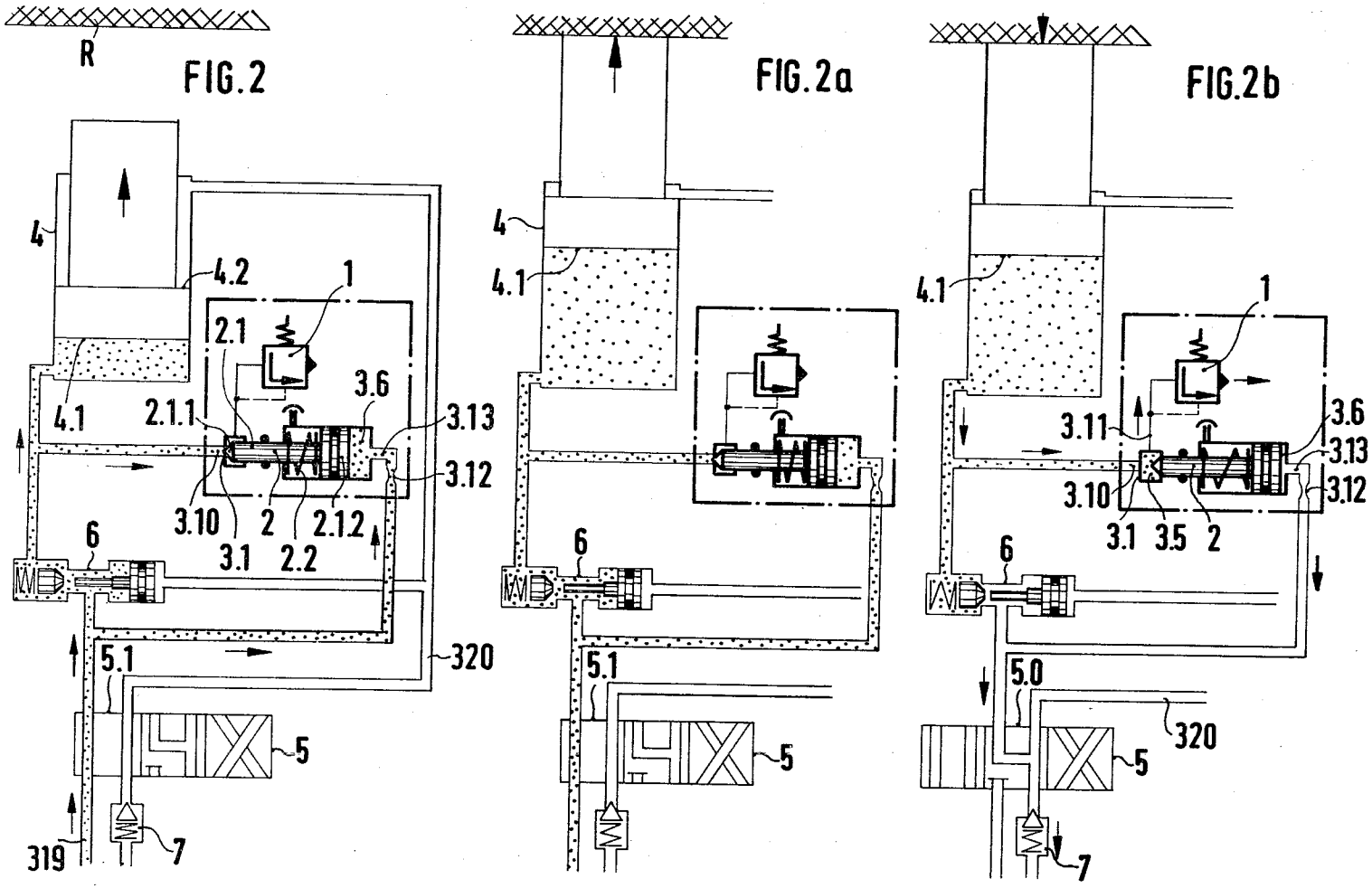
FIG. 2 is a schematic overall view of the arrangement according to the present invention.
FIG. 2*a* illustrates the various elements of the arrangement shown in FIG. 2 during expansion of the prop.
FIG. 2*b* shows the arrangement of FIG. 2 while the prop is fully expanded and the mine roof presses on the prop.

Especially the arrangement shown in FIG. 1 may be advantageously used in a control system as schematically illustrated in FIGS. 2, 2*a* and 2*b*.

FIG. 2 illustrated the various elements in the hydraulic circuit according to the present invention in a position for expanding the prop 4. In the position as illustrated in FIG. 2 pressure fluid is passed from a source of such pressure fluid, for instance a pump not illustrated in the drawing, into a channel 319 and flows when the four port-three position main valve 5 is in the position 51 as shown in FIG. 2, past the hydraulically operated check valve 6, which is in the open position, into the interior of the prop 4 to impinge on the bottom face 41 of the prop. The cylinder space of the prop above the annular surface 42 of the prop piston is thereby connected over a return conduit 320, the main valve 5 and a check valve 7 to a tank, not illustrated in the drawing.

Simultaneously the pressure fluid flows also through the bypass upstream of the hydraulically controlled check valve 6 over the throttle 312 through the control channel 313 into the control chamber 36 and downstream of the valve 6 over the inlet channel 310 onto the valve cone 211 of the two port-two position valve 2 as shown by the dots in the various channels. Since the area of the control piston 212 impinged by the pressure fluid is considerably greater than the area of the valve cone 211, the valve 2 is held against the tension of the compression spring 22 in closed position, in which the valve cone 211 engages the valve seat 311. Thereby the connection between the interior of the prop beneath the piston surface 41 and the overpressure valve 1 is interrupted.

FIG. 2*a* illustrates the position of the various elements of the hydraulic circuit according to the present invention when the piston of the prop is pressed with the total setting pressure against the mine roof. In this position of the prop the hydraulically controlled two port-two position valve 2 is still in the closed position so that the full pressure supplied to the system through the conduit 319 may not pass into the overpressure valve 1 to lead to a premature desctruction of the same.

After the prop 4 has reached its fully extended position, the main valve 5 is moved to its middle position 50, as shown in FIG. 2*b*, to thereby connect the return conduit 320 and the control circuit 313 over the check valve 7 to the non-illustrated tank. In this position of the main valve 5 the hydraulically controlled check valve 6 will close and the control space 36 of the valve 2 will be relieved of pressure so that the fluid in the interior of the prop below the piston surface 41 will pass through the inlet conduit 310 to act against the vale cone 211 and this fluid pressure together with the pressure of the spring 22 will move the control piston 212 toward the right, as viewed in FIG. 2*b*, so that pressure fluid may flow through the passage 311 to the overpressure valve 1. The opening of the valve 2 will be delayed by the throttle 312 in such a manner so that sudden impingement of the overpressure valve with pressure fluid is avoided.

Figure 4:
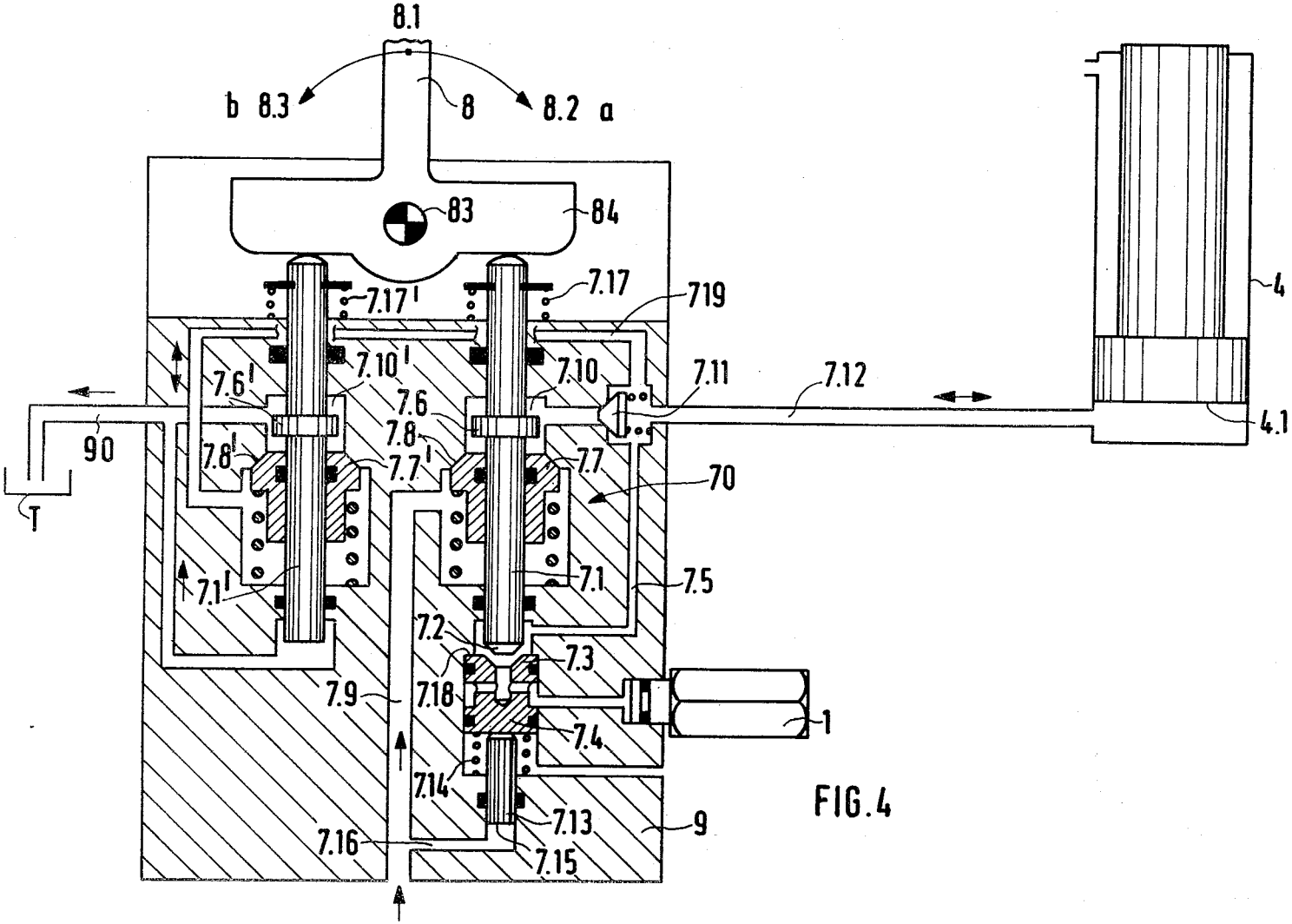
FIG. 4 is a schematic sectional view of a further arrangement according to the present invention and illustrating a mechanically controlled main valve with a two port-two position valve and an overpressure valve.

FIG. 4 illustrates a further embodiment according to the present invention in which the control arrangement is mechanically actuated. In the arrangement shown in FIG. 4 the main valve 5 shown in FIG. 1 is replaced by a valve arrangement 70 actuatable by a three armed lever 8 pivotable about a pivot point 83. The main valve 70 shown in FIG. 4 comprises two parallel transversely spaced push rods 71 and 71' guided in appropriate bores of the housing 9 for movement in longitudinal direction and respectively pressed by springs 717 and 717' against the bottom face of the transverse arm 84 of the actuating lever 8. Each of the push rods 710 and 710' has intermediate its ends a collar 76, respectively 76', arranged in a chamber 710, respectively 710', of the housing 9 to engage upon downward movement of the respective push rod a valve member 77, respectively 77' which is pressed by springs against corresponding valve seats 78 and 78'. The lower end of the push rod 71 is formed with a valve cone 72 adapted to engage during its downward movement a corresponding valve seat 73 formed in a valve member 74 which is normally pressed by a compression spring 714 against an abutment 718 to be held in the position as shown in FIG. 4.

Upon turning of the lever 8 in clockwise direction, as indicated by the arrow 82, the right portion of the transverse arm 84 of the lever will engage the upper end of the push rod 71 to move the latter against the force of the compression spring 717 in downward direction, so that the collar 76 thereon will engage the valve member 77 to displace the latter in downward direction, so that pressure fluid passed into the channel 79 may pass passed the check valve 711 and the channel 712 into the interior of the prop below the piston surface 41 of the latter to move the prop to the extended position. Simultaneously therewith the valve cone 72 at the lower end of the push rod 71 will engage the valve seat 73 of the valve member 74 to displace the latter against the pressure of the spring 714 in downward direction so as to interrupt passage of pressure fluid through the channel 75 to the overpressure valve 1. During the downward movement of the valve member 74 the valve seat 73 thereof is pressed against the cone 72 on the push rod 71 not only by the force of the compression spring 714, but also by the pressure of a support piston 713, the bottom face 715 thereof is impinged by fluid pressure passing from the channel 79 through a connecting channel 716.

After the prop 4 has been moved to its fully extended position, the lever 8, when released, is moved by the push rod 71, the compression spring 717 and the fluid forces acting on the valve cone 72 at the lower end of the push rod 71 and the fluid forces acting on the valve member 77 back to its middle position as shown in FIG. 4. During such upward movement of the push rod 71 the valve cone 72 at the lower end thereof will be disengaged from the valve seat 73 of the valve member 74 when the latter is pressed by the spring 714 and the fluid pressure acting on the support piston 713 against the abutment 178, so that the pressure fluid in the prop 4 beneath the lower surface 41 of the piston therein will be transmitted over the channels 712 and 75 to the overpressure valve 1.

If it is now desired to move the prop 4 to a collapsed position, the lever 8 is turned from the position shown in FIG. 4 in counterclockwise direction, as indicated by the arrow 83, so that the left portion of the transverse arm 84 will engage the push rod 71' to move the latter in downward direction so that the collar 76' thereon will engage the valve member 77' to move the same to the open position so that the pressure fluid from the interior of the prop below the piston surface 41 may pass through the channel 712, a connecting channel 719, communicating therewith, past the open valve member 77′ into the chamber 710′ and from there through an outlet channel 90 into the tank T.

It will be understood that each of the elements described above, or two or more together, may also find a useful applicatiion in other types of arrangements for controlling operation of mine roof supports differing from the types described above.

While the invention has been illustrated and described as embodied in an arrangement for controlling operation of a mine roof support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of operating a mine roof support having a hydraulically operated expandable and collapsable prop to be expanded with a predetermined setting pressure against the mine roof and an overpressure valve normally communicating with the cylinder space of the the prop below the piston therein and adjusted to a pressure equal to said setting pressure to protect the prop against excessive stresses, said method comprising the steps of connecting said cylinder space of said prop to a hydraulic pressure circuit to expand and press the piston of said prop with said predetermined setting pressure against the mine roof while interrupting communication between said cylinder space of said prop and the overpressure valve; and disconnecting said cylinder space of said prop from said hydraulic pressure circuit after the prop has been fully expanded and restoring communication of said overpressure valve with said cylinder space of said prop.

2. An arrangement for controlling operation of a mine roof supporting having a hydraulically operated expandable and collapsable prop to be expanded and pressed with a predetermined setting pressure against the mine roof and an overpressure valve normally communicating with the cylinder space of the prop below the piston therein and adjusted to a pressure equal to the setting pressure to protect the prop against excessive stresses, said arrangement comprising a source of hydraulic fluid of said predetermined pressure; a hydraulic circuit connecting said source to said cylinder space of said prop; a main valve in said hydraulic circuit movable between a closed position interrupting flow of pressure fluid to said cylinder space of said prop and an operating position in which pressure fluid is fed into said cylinder space; and two port-two position valve means constructed and arranged in said circuit for interrupting communication of said overpressure valve with cylinder space of said prop when said main valve during expansion of said prop is in said operating position and for restoring communication between said cylinder space of said prop and said over-pressure valve after expansion of the prop and pressing the same against the mine roof when said main valve is moved to said closed position.

3. An arrangement as defined in claim 2, wherein said two part-two position valve means is operated by the fluid pressure in said hydraulic circuit.

4. An arrangement as defined in claim 3, wherein said two port-two position valve means includes piston means movable between an open position providing communication between said cylinder space of said prop and said overpressure valve and a closed position interrupting such communication, spring means biasing said piston means to said open position, said hydraulic circuit including a passage feeding pressure fluid to one side of the piston means for moving the latter against the force of said spring means to said closed position, said main valve in said operating position connecting said passage to said source and in said closed position connecting said passage to a tank so that said spring means will move said piston means to said open position; and including a throttle in said passage to delay movement of said piston means to said open position.

5. An arrangement as defined in claim 3, and including the housing forming with said two position valve means and said overpressure valve an integrated unit.

6. An arrangement as defined in claim 5, wherein said two port-two position valve is formed in said housing and said overpressure valve is connected to said housing.

7. An arrangement as defined in claim 6, and including means for releasably connecting said overpressure valve to said housing.

8. An arrangement as defined in claim 6, wherein said housing is plate-shaped and includes connecting means for connecting said housing to said hydraulic circuit.

9. An arrangement as defined in claim 2, and including hydraulically controlled one-way valve means in said hydraulic circuit between said main valve and said prop movable between an open and a closed position and constructed and arranged to be in said open position when said main valve is in said operating position and to be in said closed position when said main valve is in said closed position.

10. An arrangement as defined in claim 9, wherein said one-way valve means comprises chamber means forming a valve seat, a valve member in said chamber means to one side of said valve seat, spring means pressing said valve member against said valve seat, a piston in said chamber to the other side of said valve seat and having a projection adapted to engage said valve member to move the latter against the force of said spring means away from said valve seat, further spring means cooperating with said piston of said one-way valve means for moving said projection away from said valve member, and a fluid passage connected to said hydraulic circuit and communicating with said chamber means at that side of said piston which is opposite the side thereof on which the projection is provided.

11. An arrangement as defined in claim 10, and including a housing forming with the two port-two position valve means, said one-way valve means and said overpressure valve an integrated unit.

12. An arrangement as defined in claim 11, wherein said two port-two position valve means includes a cylinder chamber and a piston movable in said cylinder chamber between said open and said closed position, wherein said housing is plate-shaped, wherein said cylinder chamber of said two port-two position valve means and said chamber means for said one-way valve means are formed in said plate-shaped housing and including a plurality of bores in said housing connecting said cylinder chamber, said chamber means and said overpressure valve to each other and to said hydraulic circuit.

13. An arrangement as defined in claim 2, and including biasing means biasing said main valve to said closed position and means for moving said main valve against the force of said biasing means from said closed to said operating position, said moving means being arranged and constructed to cooperate also with said two port-two position valve means for interrupting communication of said overpressure valve with said cylinder space of said prop when said moving means moves said main valve from said closed to said operating position and for reestablishing communication between said overpressure valve and said cylinder space of said prop when said main valve is moved by said biasing means back to said closed position.

* * * * *